US005657741A

United States Patent [19]

Todd

[11] Patent Number: 5,657,741

[45] Date of Patent: Aug. 19, 1997

[54] QUICK RELEASE COUPLING FOR ARCHERY BOW STABILIZER

[76] Inventor: Gary J. Todd, 33551 Giftos, Clinton Township, Mich. 48032

[21] Appl. No.: 545,419

[22] Filed: Oct. 19, 1995

[51] Int. Cl.[6] ..... F41B 5/20

[52] U.S. Cl. ..... 124/89

[58] Field of Search ..... 124/86, 89; 285/316; 403/324, DIG. 4

[56] References Cited

U.S. PATENT DOCUMENTS

| | | | |
|---|---|---|---|
| Re. 23,120 | 6/1949 | Earle et al. | 285/316 X |
| 1,353,299 | 9/1920 | Wilson | 403/DIG. 4 X |
| 2,279,146 | 4/1942 | Schneller | 285/316 X |
| 2,467,100 | 4/1949 | Spooner | 285/316 X |
| 2,552,543 | 5/1951 | Earle et al. | 285/316 X |
| 3,412,725 | 11/1968 | Hoyt | 124/89 X |
| 3,524,441 | 8/1970 | Jeffery | 124/89 |
| 5,038,510 | 8/1991 | Duke | 124/86 X |
| 5,388,563 | 2/1995 | Hsu | 124/89 X |
| 5,513,622 | 5/1996 | Musacchia | 0124/89 |

*Primary Examiner*—John A. Ricci
*Attorney, Agent, or Firm*—Charles W. Chandler

[57] ABSTRACT

A quick-release coupling for connecting a stabilizer to an archery bow. The coupling has a sleeve that is moveable linearly away from the bow in order to separate the two halves of the coupling, one of which is connected to the bow and the other connected to the stabilizer.

2 Claims, 2 Drawing Sheets

QUICK RELEASE COUPLING FOR ARCHERY BOW STABILIZER

BACKGROUND OF THE INVENTION

This invention is related to a coupling device for releasably connecting a stabilizer to an archery bow. A stabilizer is commonly mounted on an archery bow to reduce the vibration of the bow. The stabilizer has a threaded stud mounted in a pre-existing tapped hole in the bow so as to extend in a horizontal direction from the bow. It is frequently necessary to either remove or exchange the stabilizer which requires the archer to take the time to unscrew the stabilizer from the bow, and screw in a replacement stabilizer.

SUMMARY OF THE INVENTION

The broad purpose of the present invention is to provide a quick release coupling for connecting a commercially available stabilizer to the conventional tapped hole in the bow. In the preferred embodiment of the invention, the coupling comprises a first coupling member having a tapped hole which receives the threaded stud on the stabilizer, and a second coupling member which has a threaded stud which is screwed into the tapped hole in the bow. The first coupling member has a female opening for receiving a male end of the second coupling member. The first coupling member has three small balls that releasably lock the two coupling members together. A spring-biased sleeve carried on the first coupling member is retracted to separate the two coupling members.

The coupling permits the archer to quickly separate the stabilizer from the bow by sliding the sleeve on the coupling. He joins the two coupling members together by retracting the sleeve until the two coupling members are mated together and then releasing the sleeve so that the stabilizer is firmly connected to the bow.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
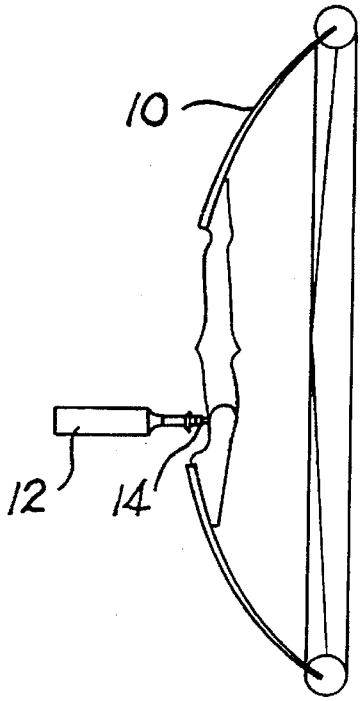
FIG. 1 is a view of a conventional archery bow with a stabilizer connected by a coupling illustrating the preferred embodiment of the invention.
Figure 2:
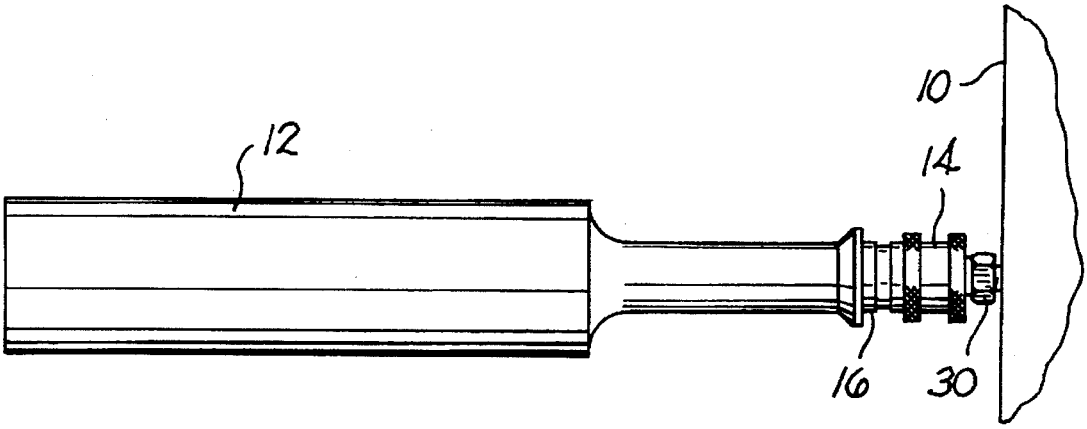
FIG. 2 is an enlarged view of the coupling.

Referring to the drawings, FIG. 1 illustrates a conventional archery bow 10. A conventional stabilizer 12 is connected by a coupling device 14 illustrating the preferred embodiment of the invention.

Coupling 14 comprises a first coupling member 16 having a tapped hole 18 in one end for threadably receiving threaded stud 20 of the stabilizer. Coupling member 16 has a tubular opposite end 22 with a cylindrical internal opening 24. Tubular end 22 has 3 circumferentially-spaced small ball-receiving opening means 26 for receiving 3 balls 28. Each ball has a diameter greater than the wall thickness of tubular end 22. Each opening 26 has a somewhat tapered configuration which prevents the balls from dropping entirely into internal opening 24. Each ball is moveable between an inner latching position illustrated in FIG. 4 in which it extends into internal opening 24, and an outer release position in which it is removed from opening 24.

Figure 3:
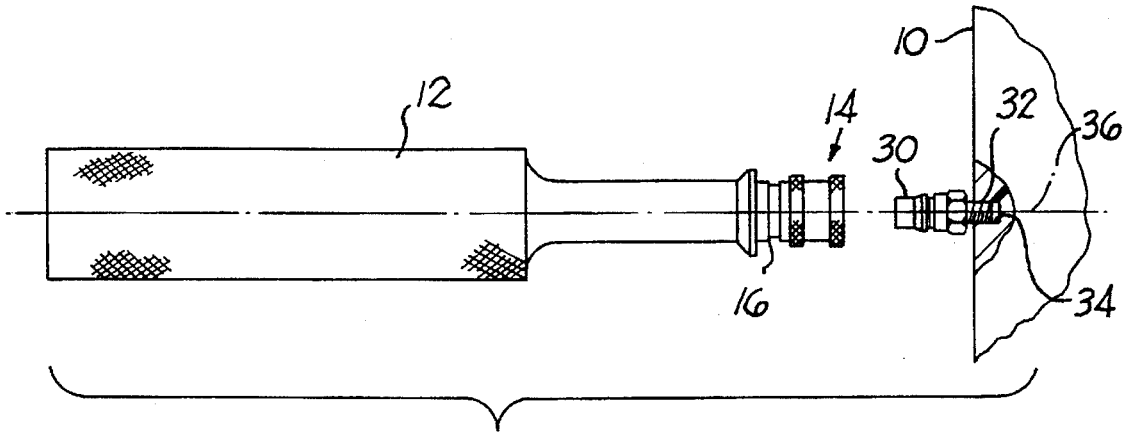
FIG. 3 is a view similar to FIG. 2, but showing the two coupling components separated.

A male second coupling member 30, as best illustrated in FIG. 3, has a threaded end 32 that is threadably receivable in the conventional tapped hole 34 of the bow. The tapped hole is formed about an axis 36. Member 30 also has an integral hexagonal section 38 adjacent the threaded end to permit the archer to tighten the coupling member on the bow.

The opposite end 40 of the second coupling member comprises a reduced cylindrical diameter plug section receivable in opening 24. End 40 has an annular collar 42 slidably received in opening 24 and which passes balls 28 as end 40 is being inserted into the opening. Coupling end 40 also has an annular groove 44 for receiving the balls when they are in their inner, latching position. When the balls are in their latching position, they prevent end 40 from being withdrawn from opening 24 by engaging the collar and blocking its path of motion out of opening 24.

Figure 4:
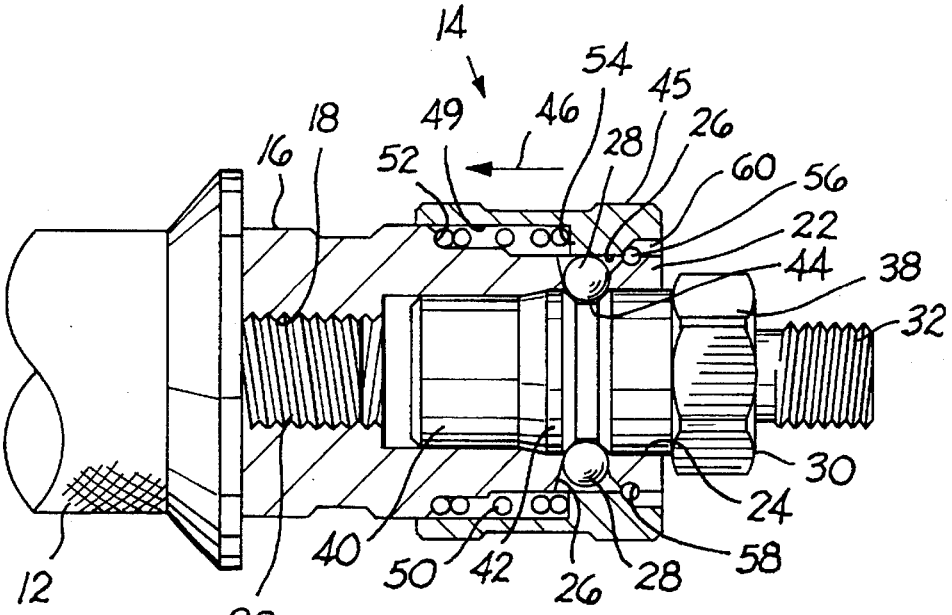
FIG. 4 is an enlarged partially cross-sectional view of the coupling.

A sleeve 45 is slideably reciprocally mounted on coupling member 16 so as to be moveable from a sleeve latching position, illustrated in FIG. 4, in the direction of arrow 46 toward a sleeve release position. Arrow 46 is parallel to axis 36 of the tapped hole in the bow when the two coupling members are joined together. The sleeve has a knurled outer surface to permit the archer's fingers to firmly grasp the sleeve and move it to the left and the sleeve release position.

The sleeve has an inner cylindrical wall 49 which with tubular end 32 form a generally annular cavity for housing a coil spring 50. Spring 50 is mounted between a shoulder 52 on coupling member 16 and an inner annular ridge 54 on the sleeve. Spring 50 biases the sleeve toward the bow and the sleeve latching position in which ridge 54 prevents balls 28 from moving radially outwardly from their ball-latching positions.

A snap ring 56 is mounted in an annular groove 58 adjacent the end of coupling member 16 to prevent the sleeve from sliding off the end of coupling member 16. The device can be disassembled by expanding snap ring 56 to remove it from groove 58.

The sleeve has an annular internal cavity 60 adjacent the outer end of the sleeve which registers with the balls when the sleeve has been fully retracted toward the left and its sleeve-release position, as viewed in FIG. 4. In this release position, the balls are free to move outwardly and partially into cavity 60 a sufficient distance to permit collar 42 to pass the balls as the two coupling members are pulled apart.

Thus, the stabilizer can be readily connected to the bow by linearly retracting the sleeve in the arrow 46 direction. The right frusto-conical side of collar 42 cams the balls into cavity 60 as the two coupling members are separated.

Coupling end 40 can be inserted into opening 24 with the opposite frusto-conical side of collar 42 camming the balls into cavity 60 until end 40 has been received to a fully latched position in which the balls move into groove 44. When the user releases the sleeve, spring 52 biases the sleeve toward the right until it abuts snap ring 56. When the sleeve engages snap ring 56, ridge 54 then engages the balls, preventing them from moving outwardly from groove 44, thereby securely latching the two coupling members together.

Having described my invention, I claim:

1. In an archery bow having a pre-existing threaded opening (34) formed along an axis (36) generally at right angles to the longitudinal axis of the bow for receiving the threaded end of a stabilizer, the combination comprising:

a vibration-reducing stabilizer (12) that includes a relatively large diameter stabilizer body and a relatively small diameter stud (20) extending axially from said stabilizer body for threadable insertion into the threaded opening (34) in said bow:

a quick release coupling mechanism (14) threadable onto said stud to provide an alternate means of detachably connecting the stabilizer to the bow;

said coupling mechanism comprising a first coupling member (16) having a first threaded opening (18) threadable onto said stud, and a tubular side wall (22) having at least one radial opening (26) therein;

a second coupling member (30) having a smooth surfaced plug section (40) insertable into said first coupling member to assume a telescoped position within said tubular sidewall, and a threaded end section (32) adapted for threaded insertion into the threaded opening (34) in the bow, said plug section having an annular groove (44) in its side surface;

a latching ball 28 floatably positioned in each radial opening (26);

a sleeve (45) slideably mounted on said first coupling member for either moving said latching ball into said groove or releasing said latching ball our of said groove;

the threaded end section (32) on said second coupling member having the same thread size as the stud on the stabilizer, whereby the stabilizer can be attached directly to the bow or indirectly via the quick release coupling mechanism;

said sleeve having an outer diameter that is appreciably smaller than the diameter of the stabilizer body, whereby the quick release coupling mechanism can be located between the stabilizer and the bow without adversely affecting stabilizer performance;

an inwardly radiating annular ridge (54) on said sleeve slidable axially on said first coupling member between a latching position overlying said ball and a release position out of registry with said ball;

said annular ridge subdividing the sleeve inner surface into a spring-accommodation cavity (at 49) and a ball-accommodation cavity (60);

a snap ring (56) mounted on said second coupling member so as to normally be within said ball-accommodation cavity; and a coil spring (50) within said spring accommodation cavity for normally biasing said sleeve to a latching position wherein said annular ridge abuts the snap ring.

2. The combination of claim 1, wherein said threaded opening (18) is located at one end of the first coupling member, and said snap ring (56) is located at the other end of said first coupling member;

said snap ring being located beyond said ball-accommodation cavity when said sleeve is moved to the release position, whereby the snap ring is then capable of disassembly from said first coupling member.

* * * * *